US007063566B2

(12) United States Patent
Tsuchiya et al.

(10) Patent No.: US 7,063,566 B2
(45) Date of Patent: Jun. 20, 2006

(54) WATERTIGHT CONNECTOR

(75) Inventors: Takashi Tsuchiya, Yokkaichi (JP); Kazuhiko Nimura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/096,161

(22) Filed: Mar. 31, 2005

(65) Prior Publication Data

US 2005/0221672 A1 Oct. 6, 2005

(30) Foreign Application Priority Data

Apr. 2, 2004 (JP) ..... 2004-110231
Oct. 29, 2004 (JP) ..... 2004-316121

(51) Int. Cl.
*H01R 13/40* (2006.01)

(52) U.S. Cl. ..... 439/587

(58) Field of Classification Search ..... 439/587, 439/589, 595, 274, 275
See application file for complete search history.

(56) References Cited

U.S. PATENT DOCUMENTS 4,944,688 A 7/1990 Lundergan
4,973,268 A 11/1990 Smith et al.
4,998,896 A 3/1991 Lundergan
5,496,193 A * 3/1996 Kameyama ..... 439/589
5,518,415 A 5/1996 Sano
5,520,553 A * 5/1996 Cecil et al. ..... 439/595
5,659,949 A * 8/1997 Ohba et al. ..... 29/753
6,059,594 A 5/2000 Davis et al.

FOREIGN PATENT DOCUMENTS

DE 44 30 775 A1 7/1996
JP 7-201406 8/1995

* cited by examiner

*Primary Examiner*—Tulsidas C. Patel
*Assistant Examiner*—Phuongchi Nguyen
(74) *Attorney, Agent, or Firm*—Gerald E. Hespos; Anthony J. Casella

(57) ABSTRACT

A connector is provided with male terminal fittings (30), seals (50) mountable on the male terminal fittings (30), and a housing (10) formed with cavities (14) for accommodating the male terminal fittings (30) with the seals (50) held in close contact with the inner wall surfaces of the cavities (14). Each seal (50) is mounted on a tab (31) located before a wire barrel (32) in the male terminal fitting (30). Accordingly, even if water enters through the inside of the wire (90), an arrival of the water at mating portions of male and female terminal fittings (30, 80) can be avoided.

7 Claims, 13 Drawing Sheets

WATERTIGHT CONNECTOR

BACKGROUND OF THE INVENTION

1. Field of the Invention

The present invention relates to a watertight connector.

2. Description of the Related Art

Japanese Unexamined Patent Publication H07-201406 discloses a watertight connector with a housing made of a synthetic resin. Terminal fittings are accommodated in cavities in the housing. Each terminal fitting has a connecting portion for contacting a mating terminal, and a wire barrel is behind the connecting portion. The wire barrel can be crimped into connection with a section of a core exposed at an end of the wire. A rubber plug is mounted on the terminal fittings and on an insulated section of the wire behind the wire barrel. The rubber plugs are held in close contact with inner wall surfaces of the cavities to prevent entry of water.

Water may enter cavities through clearances between insulation coatings and cores of wires in a connector installed in a vehicle, and the above construction cannot prevent entry of water through this course. Further, the compressed state between the wires and the rubber plug is weakened if the diameter of the wires becomes smaller due to thermal expansion. No countermeasure has been taken against the entry of water in this manner.

The invention was developed in view of the above problems, and an object thereof is to improve watertightness.

SUMMARY OF THE INVENTION

The invention relates to a watertight connector that has a housing formed with a cavity and a terminal fitting that can be inserted into the cavity. A connecting portion is at a front end of the terminal fitting and is connectable with a mating terminal fitting. A wire barrel is behind the connecting portion and can be crimped into connection with a core exposed at an end of a wire. A seal is mounted on the terminal fitting before the wire barrel and closely contacts the inner wall surface of the cavity. Thus, the seal prevents water that enters through the inside of the wire from reaching mating portions of the terminal fittings. Further, the seal is mounted on the terminal fitting, and the metal of the terminal fitting is less likely to expand thermally as compared to the insulation coating of the wire. Thus, water is less likely to enter between the seal and the male terminal fitting.

The terminal fitting preferably is a male terminal fitting and has a tab at the front end. The seal has a mount hole for receiving and closely contacting the tab. The seal can be mounted easily on the terminal fitting by fitting the leading end of the tab in the mounting hole. An interlocking portion is formed on the tab before a mount position of the seal and is engageable with a lock in the cavity. Thus, the terminal fitting can be retained in the housing by engaging the interlocking portion and the lock while the seal is mounted.

The tab includes contact surfaces for contacting the rear surface of the seal to restrict a seal mounting operation. The tab also has a stepped surface for engaging the front surface of the seal to prevent withdrawal of the properly mounted seal. Thus, the properly mounted seal engages both the contact surfaces and the stepped surface.

The tab preferably is a flat plate with four beveled corners. Thus, the tab can closely contact the inner surface of the mount hole of the seal even at the respective corner portions.

The contact surfaces preferably are continuous with the tab and point-symmetric with respect to the tab. Thus, the contact surfaces can contact the seal in a well-balanced manner, and the seal can be held stably on the terminal fitting.

The seal preferably has a substantially elliptical cross section along a direction normal to longitudinal direction, and the cavity preferably is formed to conform to the cross section of the seal. Thus, the seal can be inserted only in a proper angular posture.

DETAILED DESCRIPTION OF THE PREFERRED EMBODIMENTS

Figure 1:
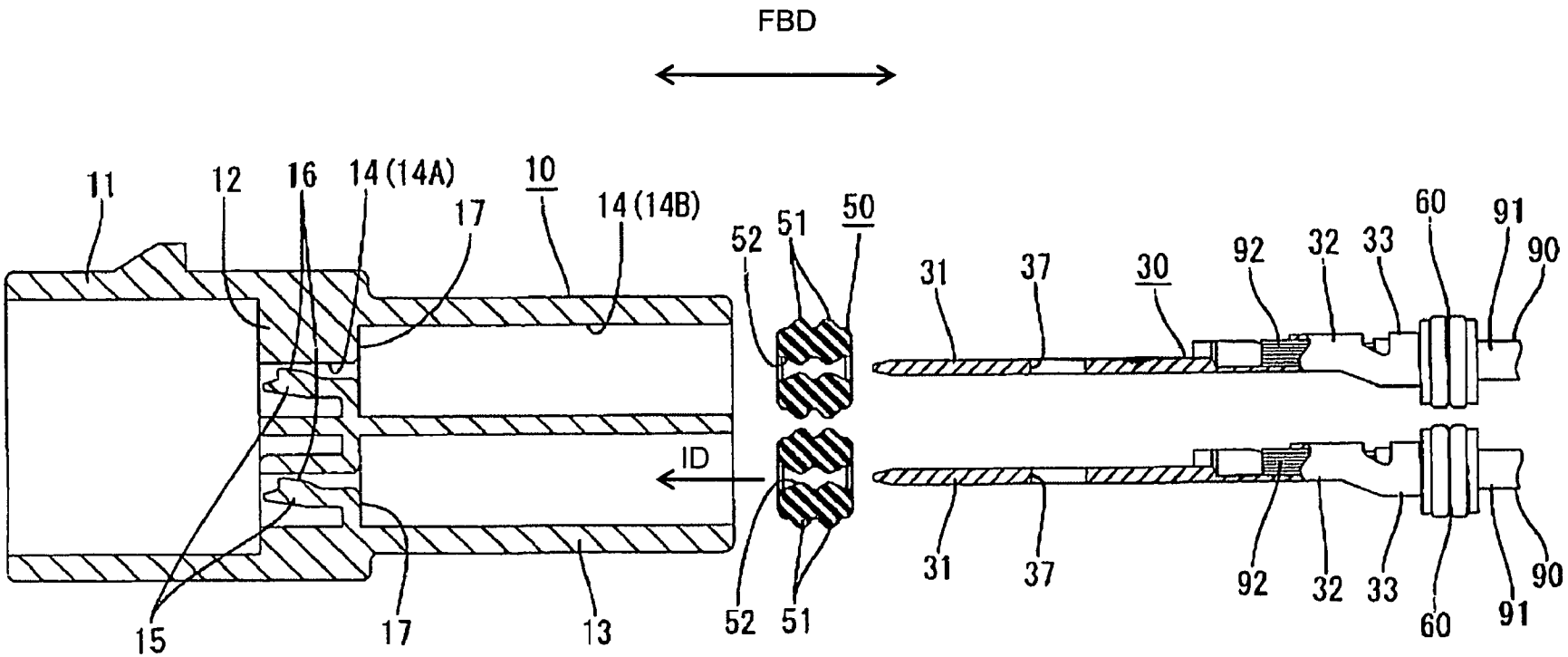
FIG. 1 is an exploded section of a connector according to a first embodiment of the invention.
Figure 2:
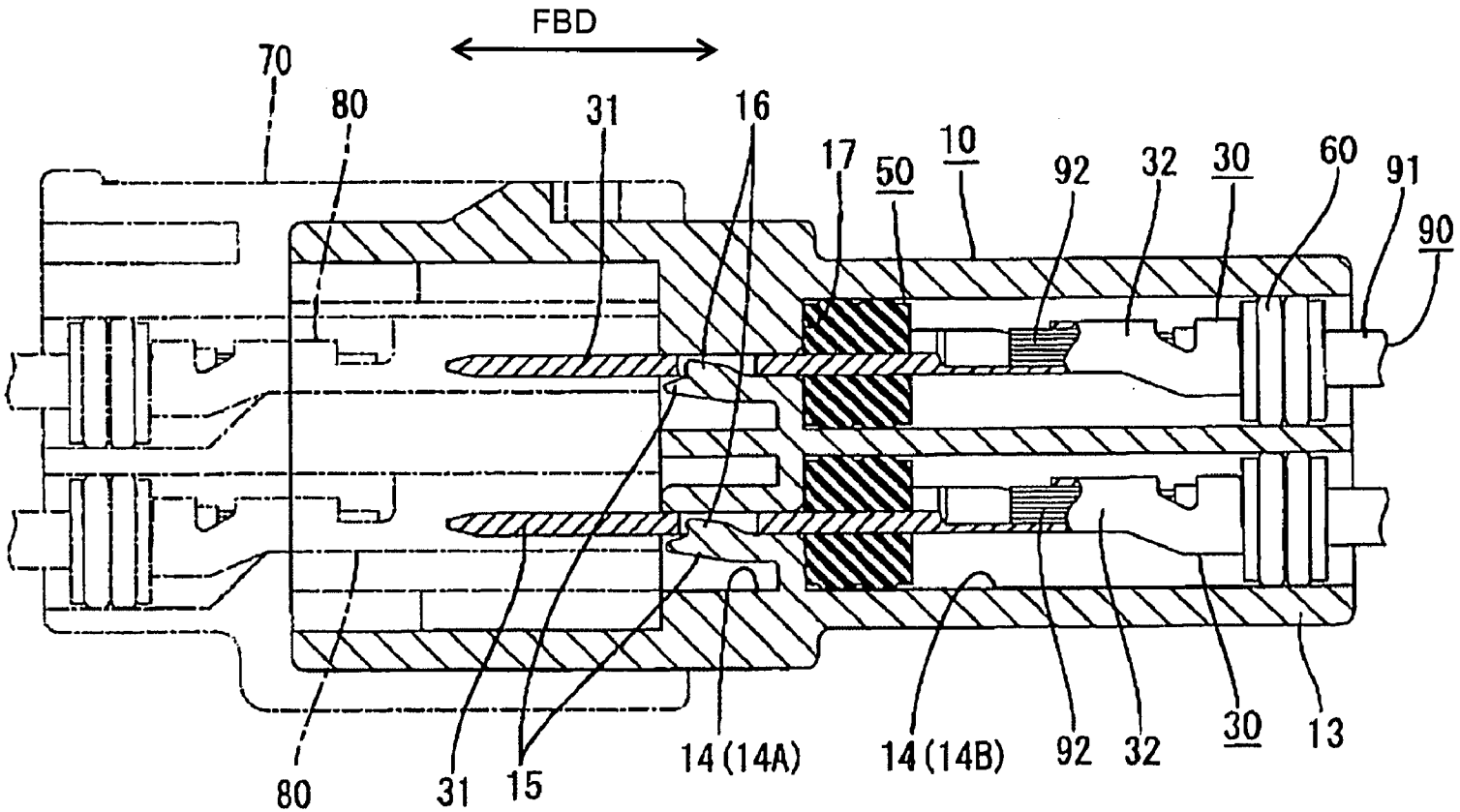
FIG. 2 is a section of the connector.

A connector according to a first embodiment of the invention is described with reference to FIGS. 1 to 6. It should be noted that left side in FIGS. 1 and 2 is referred to as the front in the following description. Additionally, the term vertical is used herein as a convenient frame of reference, but is not intended to imply a required gravitational frame of reference The connector has a housing 10 made of a synthetic resin. The housing 10 includes a substantially rectangular tubular receptacle 11 with an open front end and a back wall 12. A mating female housing 70 can be inserted into the receptacle 11 from the front. A terminal-accommodating portion 13 extends back from the back wall 12 of the receptacle 11, as shown in FIGS. 1 and 2.

Cavities 14 are arranged at upper and lower stages and penetrate the housing 10 along forward and backward directions. Each cavity 14 has a front section 14A that penetrates the back wall of the receptacle 11 and a rear section 14B that penetrates the terminal-accommodating portion 13. The rear section 14B of the cavity 14 is approximately four times longer than the front section 14A along forward and backward directions. A lock 15 is cantilevered forwardly from a lower surface of an inner wall of the front section 14A of the cavity 14. The lock 15 is resiliently deformable up and down and has a locking projection 16 formed on the leading end. The rear section 14B of the cavity 14 has a substantially constant cross-section over the entire length and is cross-sectionally larger than the front section 14A of the cavity 14. Thus, a step 17 is defined between the front and rear sections 14A and 14B of the cavity 14.

Figure 3:
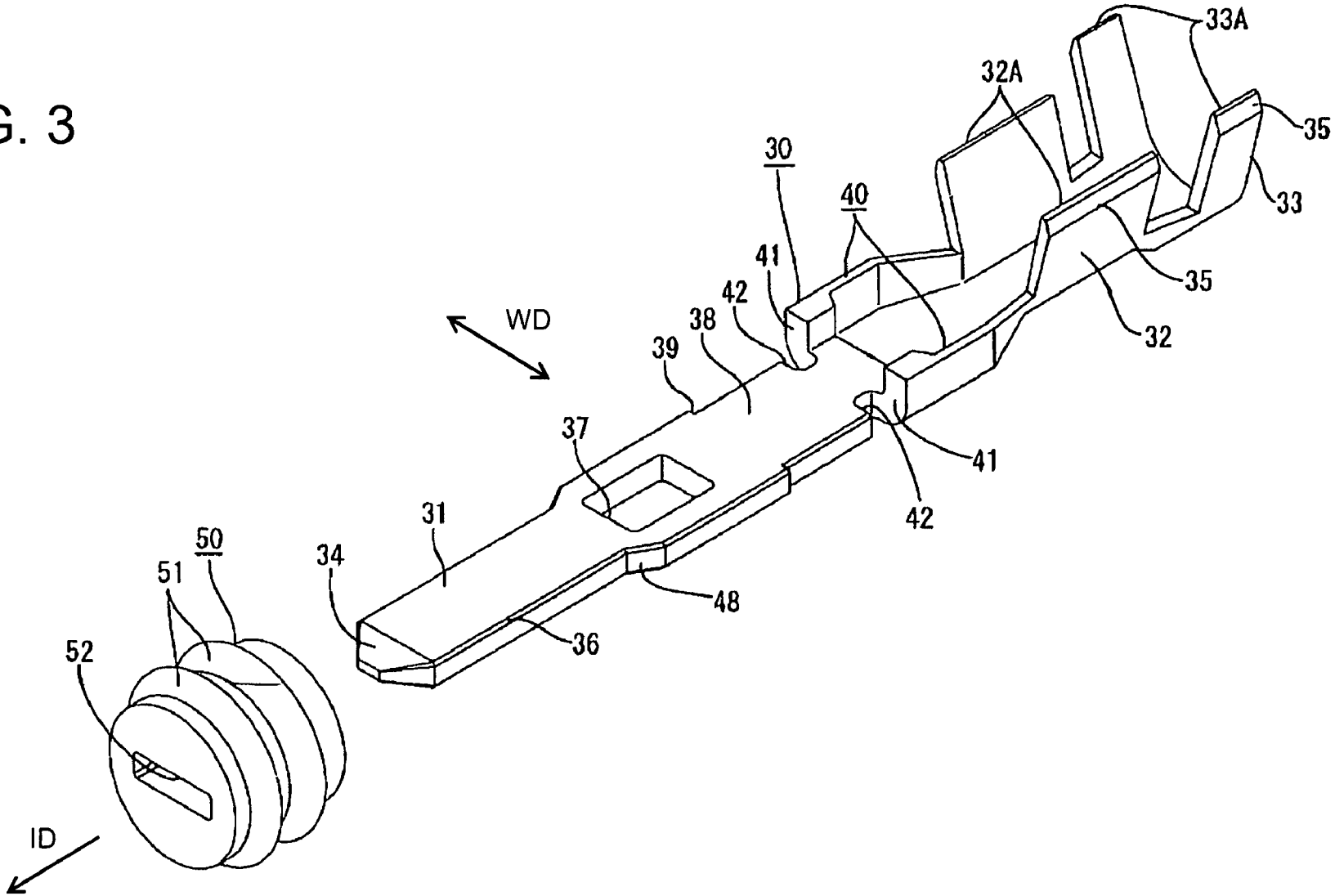
FIG. 3 is a perspective view showing a separated state of a male terminal fitting and a seal.
Figure 4:
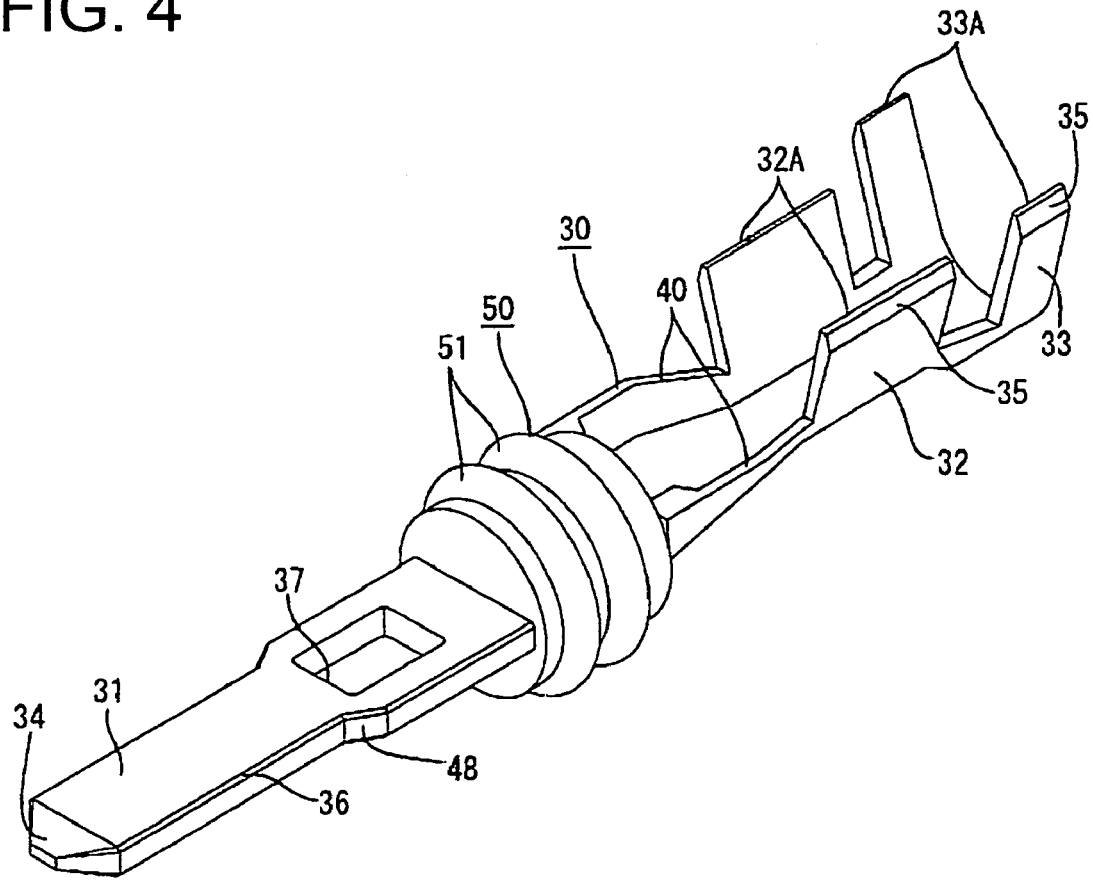
FIG. 4 is a perspective view showing an assembled state of the male terminal fitting and the seal.
Figure 5:
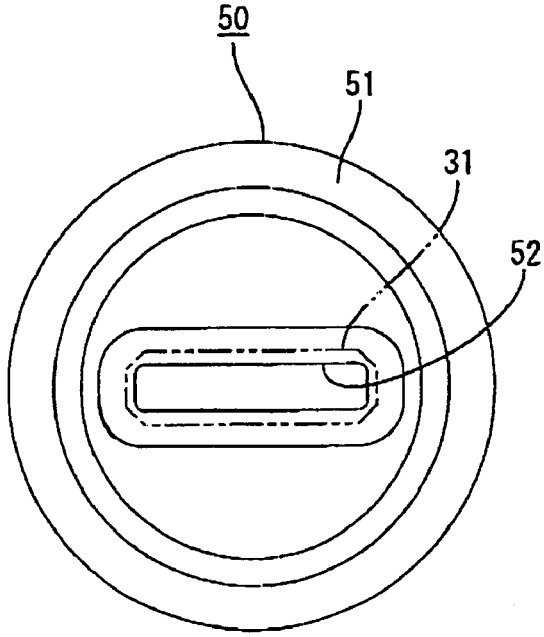
FIG. 5 is a front view of the seal.
Figure 6:
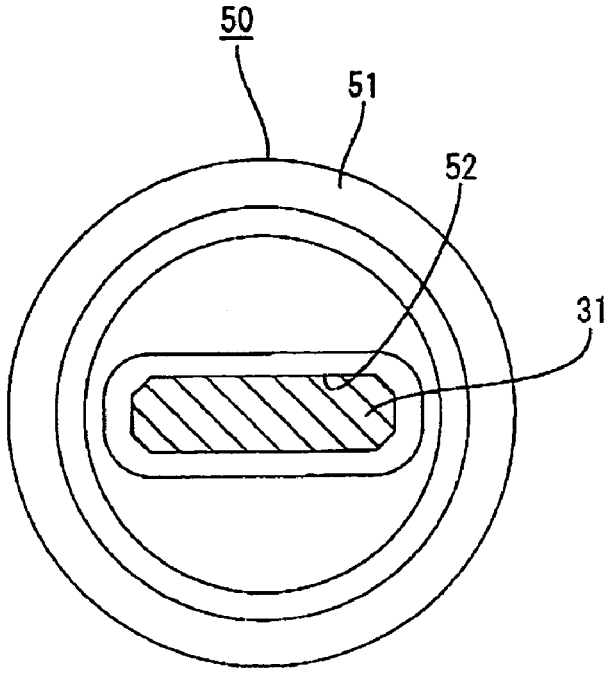
FIG. 6 is a front view of the seal mounted on a tab.

The connector also includes male terminal fittings 30 that are formed by bending an electrically conductive metal plate. Each male terminal fitting 30 has a tab 31, a wire barrel 32, an insulation barrel 33 coupled one after another in this order as shown in FIG. 3. The tab 31 projects through the front section 14A of the respective cavity 14 and into the receptacle 11. Female terminal fittings 80 of the mating female housing 70 are electrically connectable with the tabs 31 when the female housing 70 is inserted into the receptacle 11.

The insulation barrel 33 has left and right crimping pieces 33A that are wound circumferentially around an insulation coating 91 of a wire 90 for crimped connection with the wire 90. The wire barrel 32 has left and right crimping pieces 32A that are wound circumferentially around a core 92 exposed at an end of the wire 90 for a crimped connection with the core 92 that achieves electrical connection with the male terminal fitting 30. Beveling 35 is applied to the outer side surfaces of the leading ends of the crimping pieces 33A, 32A.

The tab 31 is a flat plate with four slanted guiding surfaces 34 at the leading end to facilitate insertion of the tab 31 into the cavity 14. The tab 31 also has four beveled corners 36. A substantially rectangular locking hole 37 penetrates a middle part of the tab 31 along a thickness direction. The locking projection 16 of the lock 15 formed at the inner wall of the front section 14A of the cavity 14 can fit into the locking hole 37 to retain the male terminal fitting 30 in the cavity 14.

A mount portion 38 is defined in an area of the tab 31 behind the locking hole 37. The mount portion 38 is narrower than a front area where the locking hole 37 is located, and steps 39 extend between the mount portion 38 and the front area. Two sidewalls 40 are coupled unitarily to the wire barrel 32 and stand up at the opposite widthwise edges of an area of the tab 31 behind the mount portion 38. Forwardly facing contact surfaces 41 are formed at the front ends of the sidewalls 40.

Guiding surfaces 48 are formed on the opposite widthwise edges of the tab 31 before the locking hole 37 and define a spacing that gradually widens from the front towards the back. A narrow constriction 42 is formed at the rear end of the mount portion 38 and facilitates the bending of the bending of the sidewalls 40 into the upright orientation.

The connector further includes a seal 50. The seal 50 is made of a rubber and has a cylindrical shape. Lips 51 are formed one after the other on each of the inner and outer peripheral surfaces of the seal 50. A wide rectangular mount hole 52 penetrates the seal 50 along forward and backward directions, and the inner wall surface of the mount hole 52 can closely contact the mount portion 38 of the tab 31. The mount portion 38 of the tab 31 squeezes the lips 51 on the inner peripheral surface of the seal 50 when the sealing 50 is mounted properly to provide sealing between the inner surface of the seal 50 and the mount portion 38. The seal 50 is inserted into the rear section 14B of the cavity 14 from behind and is left at a position where the front surface of the seal 50 contacts the steps 17. At this time, the lips 51 on the outer peripheral surface of the seal 50 are squeezed by the inner wall surface of the rear section 14B of the cavity 14 to provide sealing between the outer surface of the seal 50 and the inner surface of the rear section 14B of the cavity 14.

A rubber plug 60 is mountable on the insulation coating 91 of the wire 90 behind the male terminal fitting 30. The rubber plug 60 closes the opening of the rear section 14B of the cavity 14 when the male terminal fitting 30 is inserted into the cavity 14. The rubber plug 90 enhances the sealing property of the seal 50. Thus, water is prevented from reaching the mating portions of the male and female terminal fittings 30, 80.

The connector is assembled by first stripping the insulation coating 91 at the end of the wire 90 to expose the core 92. The wire barrel 32 then is crimped into connection with the core 92 and the insulation barrel 33 is crimped into connection with the insulation coating 91 of the wire 90. The rubber plug 60 can be mounted beforehand on the insulation coating 91 of the wire 90 behind the male terminal fitting 30. The seal 50 then is mounted on the male terminal fitting 30 from the leading end of the tab 31 while being in close sliding contact with the tab 31.

The tab 31 resiliently widens the mount hole 52 along the widthwise direction as the seal 50 passes the locking hole 37. The rear surface of the seal 50 contacts the contact surfaces 41 of the side walls 40 when the seal 50 reaches the mount portion 38 of the tab 31, thereby preventing further rearward movement of the seal 50. Additionally, the front surface of the seal 50 engages the steps 39 of the tab 31 to prevent the seal 50 from coming off forward. The male terminal fitting 30 and the seal 50 are inserted into the cavity 14 after the seal 50 is mounted properly on the male terminal fitting 30.

The leading end of the tab 31 contacts the locking projection 16 of the lock 15 when the tab 31 enters the front section 14A of the cavity 14. Further pushing causes the tab 31 to deform the lock 15 resiliently down. The locking projection 16 fits into the locking hole 37 of the tab 31 when the male terminal fitting 30 is inserted properly and the lock 15 is restored resiliently to its initial posture. Further, the seal 50 is at the forward end of the rear section 14B of the cavity 14 when the male terminal fitting 30 reaches a proper insertion position so that the front surface of the seal 50 contacts the steps 17. Additionally, the rubber plug 60 is near the rear opening of the cavity 14. The rubber plug 60 prevents the direct entry of water into rear section 14B of the cavity 14. Water conceivably could run through the inside of the wire 90 to reach the core 92, and hence could bypass the rubber plug 60 and enter the rear section 14B of the cavity 14 indirectly via the wire 90. However, the seal 50 prevents any such water from entering the front section 14A of the cavity 14.

As described above, the seal 50 is mounted before the wire barrel 32 to prevent water from reaching the mating portions of the male and female terminal fittings 30, 80 even if the water enters through the inside of the wire 90. Thus, connection reliability between the terminal fittings 30, 80 is ensured.

The seal 50 is mounted on the male terminal fitting 30, which is less likely to expand thermal expand than the insulation coating 91 of the wire 90. Thus, water is not likely to enter between the seal 50 and the male terminal fitting 30.

Further, the seal 50 can be mounted easily on the male terminal fitting 30 by introducing the leading end of the tab 31 into the mount hole 52, and can also be mounted and retained in the housing 10 by engaging the interlocking portion 37 and the lock 15 while the seal 50 is mounted.

Furthermore, the beveling 36 is applied to the four corners of the tab 31. Thus, the tab 31 can be held in close contact with the inner surface of the mount hole 52 of the seal 50 even at the respective corners.

Figure 7:
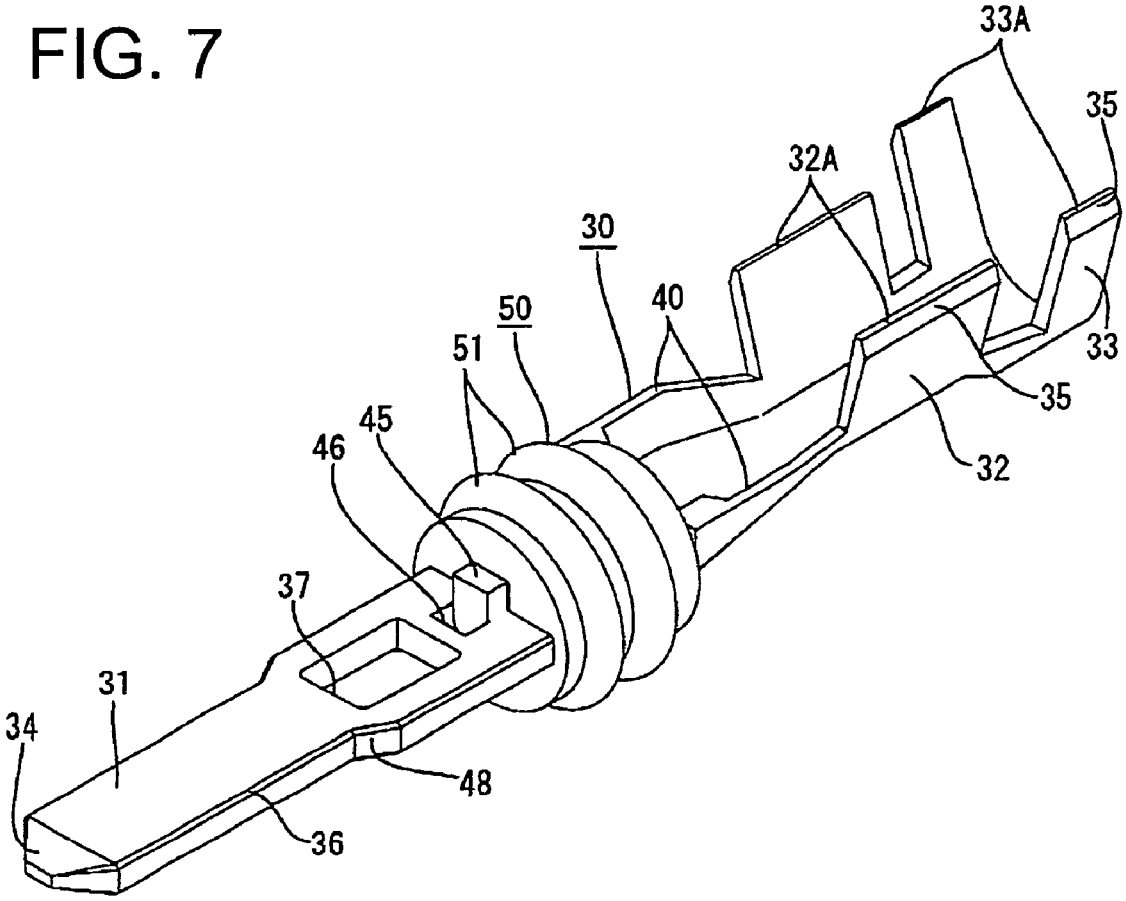
FIG. 7 is a perspective view showing an assembled state of a male terminal fitting and a seal in a second embodiment of the invention.

FIG. 7 shows a second embodiment of the invention. The second embodiment is characterized in that the tab 31 is formed with a stopper 45 to retain the seal 50 more securely. Since the other construction is substantially the same as in the first embodiment, no repeated description is given thereon and the same elements merely are identified by the same reference numerals.

In the second embodiment, the stopper 45 stands at a substantially widthwise middle right behind the locking hole 37 in the tab 31. The stopper 45 is formed by making a U-shaped cut 46 in the tab 31 and bending a piece inside this cut 46 to stand up. The seal 50 mounted on the mount portion 38 of the tab 31 and the front surface of the seal 50 is held in contact with the rear surface of the stopper 45 to prevent the seal 50 from coming off forward.

FIGS. 8 to 15 show a third embodiment of the present invention. In the third embodiment, the shape of the contact surface 41, that of the seal 50 and that of the cavities 14 differ from those of the first embodiment. Since the other construction is substantially the same as in the first embodiment, no repeated description is given thereon and the same elements merely are identified by the same reference numerals.

Figure 12:
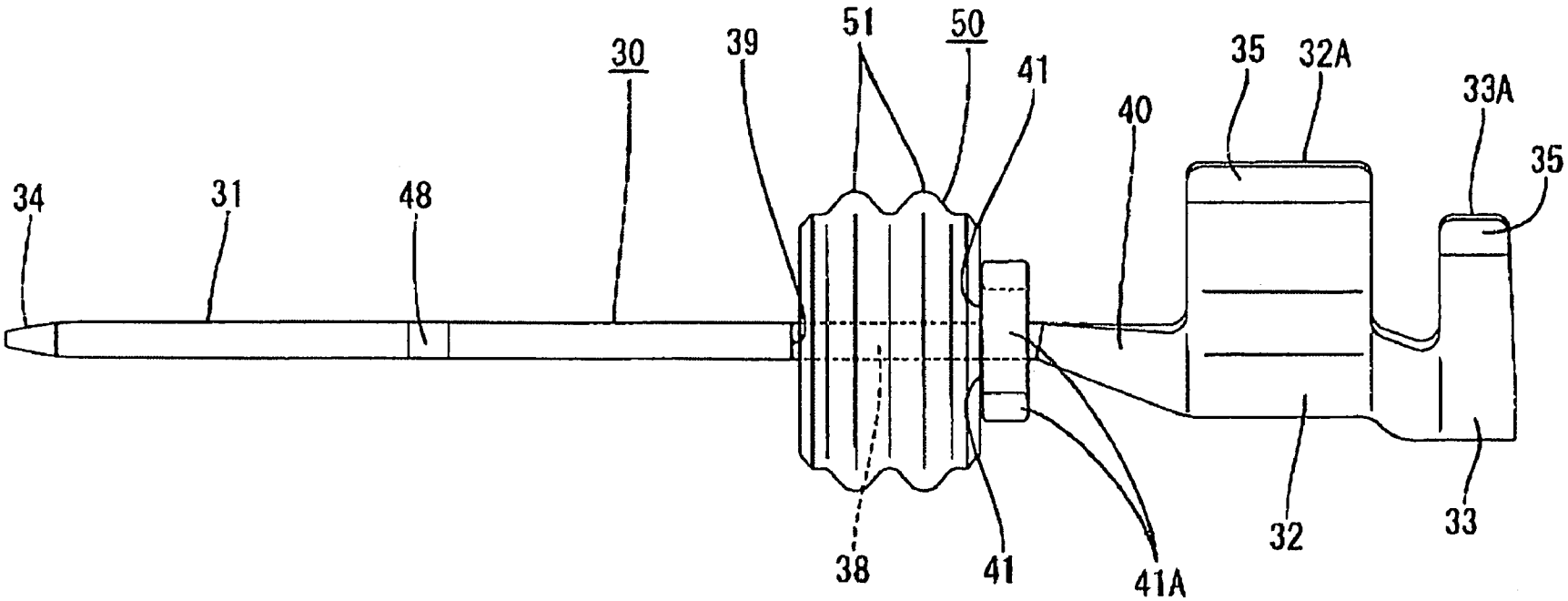
FIG. 12 is a side view showing an assembled state of the male terminal fitting and a seal.
Figure 13:
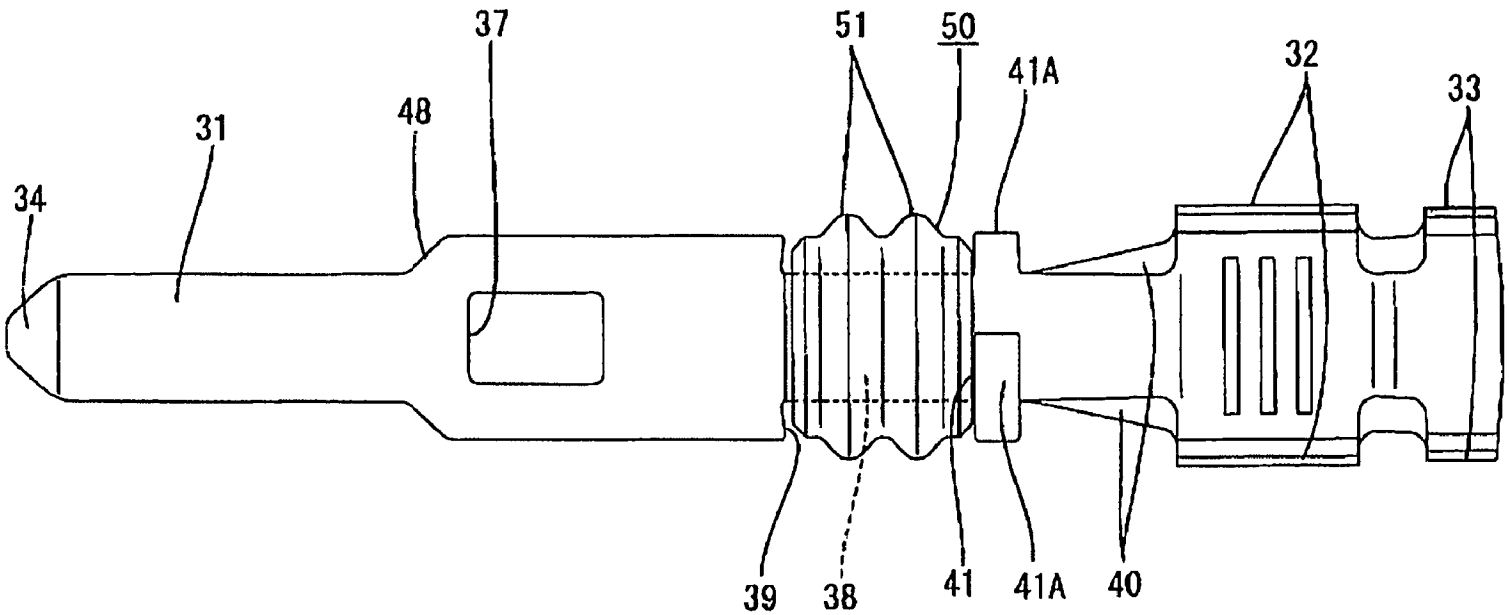
FIG. 13 is a plan view showing the assembled state of the male terminal fitting and the seal.
Figure 14:
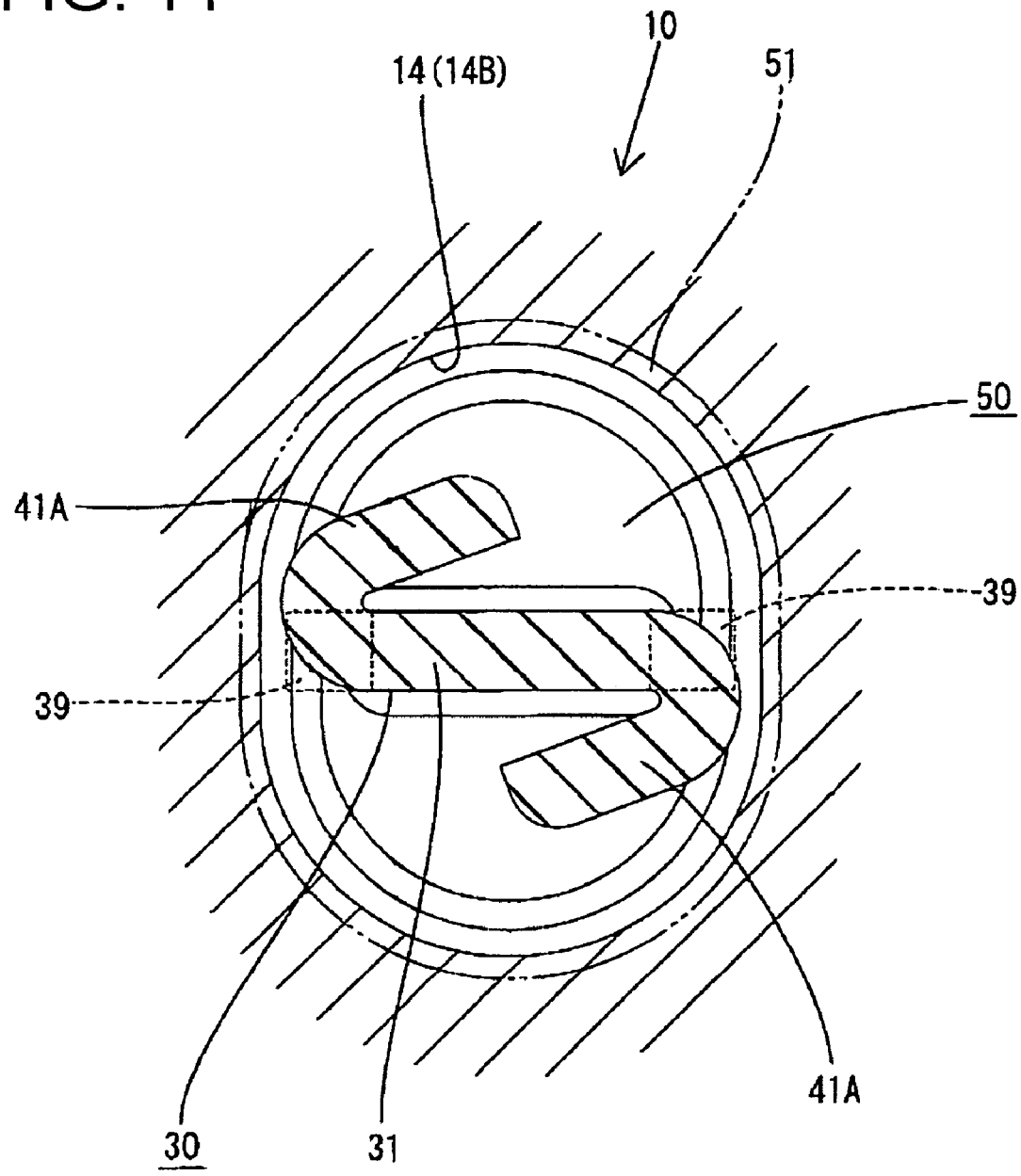
FIG. 14 is a section along 14—14 of FIG. 11.

As shown in FIGS. 12 to 14, left and right flat stoppers 41A are formed at the front ends of the side walls 40 and at the opposite widthwise edges in an area of the tab 31 behind the mount portion 38 of the male terminal fitting 30. The stoppers 41A contact the rear surface of the seal 50 to restrict the mounting operation. Contact surfaces 41 are defined at the front edges of the stoppers 41A. The stopper 41A extending from the left edge of the tab 31 in FIG. 14 is bent up from the tab 31, whereas the stopper 41A extending from the right edge of the tab 31 in FIG. 14 is bent down from the tab 31. The stoppers 41A extend substantially equal distances from the tab 31, and are substantially half as wide as the tab 31 in an area where the stoppers 41A are formed. Angles between the plate surfaces of the respective stoppers 41A and the plate surfaces of the tab 31 are substantially equal. Thus, the respective contact surfaces 41 are point-symmetric with respect to the tab 31.

Figure 15:
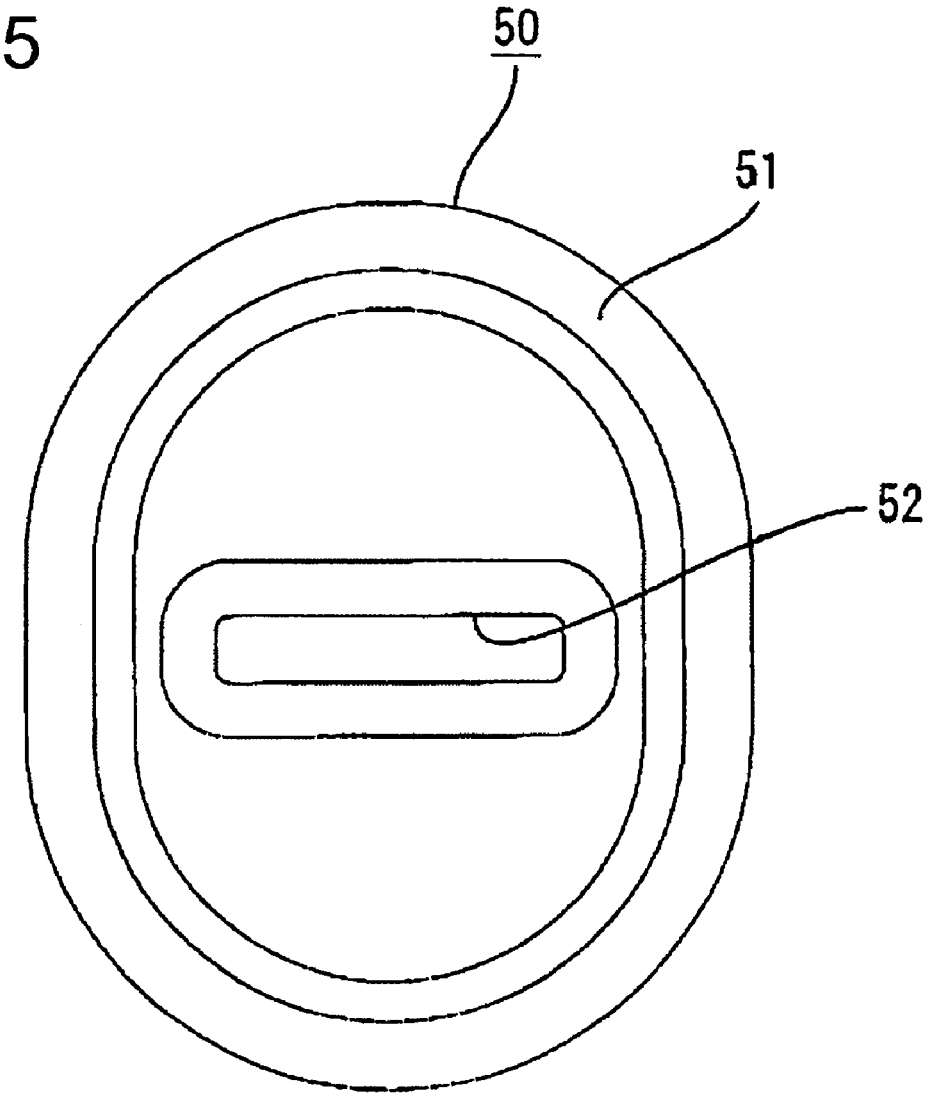
FIG. 15 is a front view of the seal according to the third embodiment.

As shown in FIG. 15, the seal 50 is made of a rubber and has a tubular shape with a substantially elliptical cross section along a direction normal to longitudinal direction and the major axis of the cross section extends vertically. A wide rectangular mount hole 52 penetrates the seal 50 along forward and backward directions, and the inner wall surface of the mount hole 52 can closely contact the mount portion 38 of the tab 31.

As shown in FIG. 14, the rear section 14B of the cavity 14 has an elliptical cross section along a direction normal to longitudinal direction, and the major axis extends vertically. The seal 50 can be inserted into the rear section 14B of the cavity 14 only in rotational a posture where the major axes of the cross sections of the seal 50 and the rear section 14B of the cavity 14 conform. The inner peripheral wall of the rear section 14B of the cavity 14 is slightly smaller than the outer periphery of the seal 50. Thus, the outer periphery of the seal 50 closely contact the inner peripheral wall of the rear section 14B of the cavity 14 to provide sealing between the rear section 14B of the cavity 14 and the seal 50.

Figure 8:
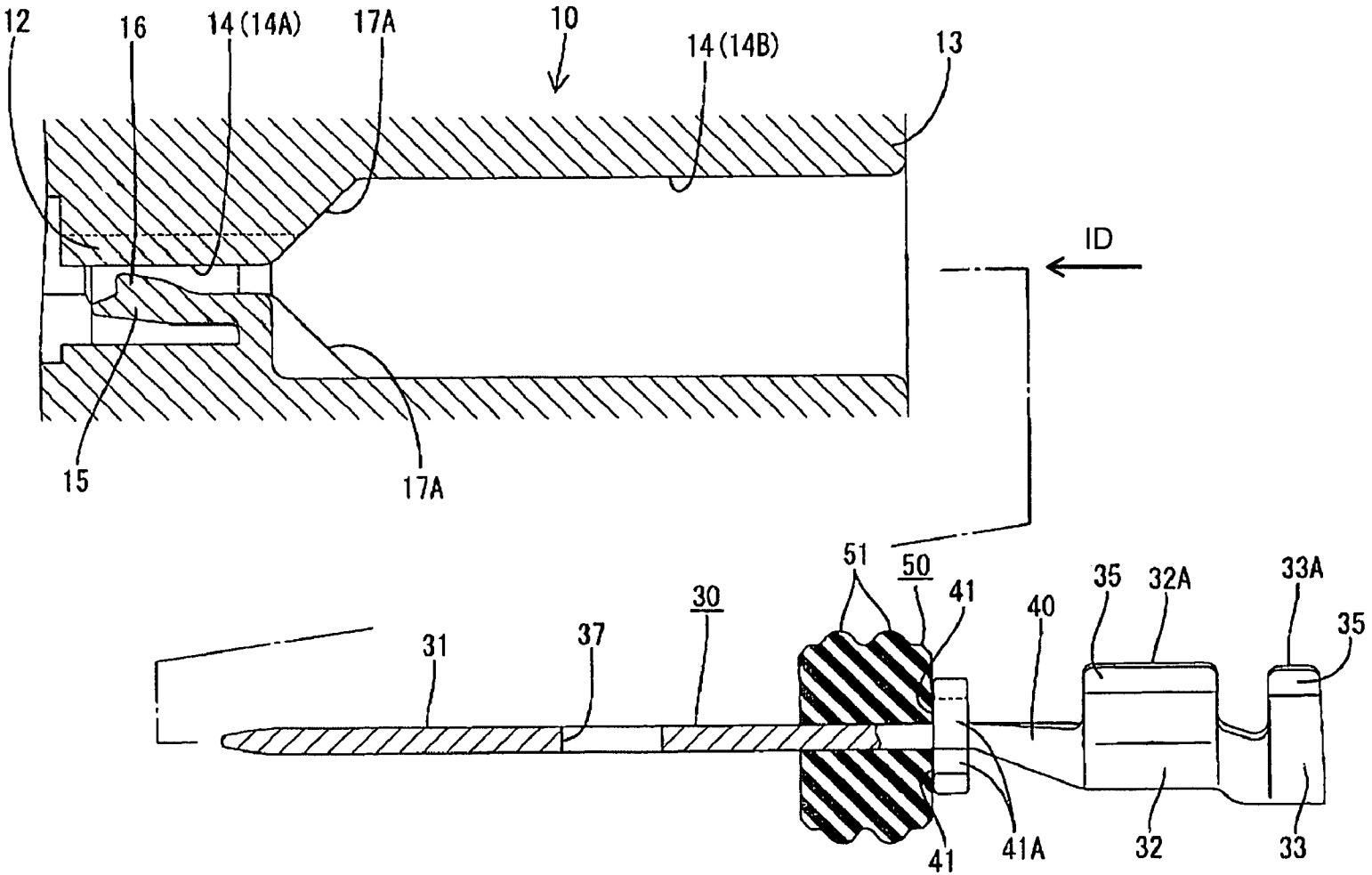
FIG. 8 is an exploded section of a connector according to a third embodiment of the invention.

As shown in FIG. 8, a slanted surface 17A is defined between the front and rear sections 14A and 14B of the cavity 14 for gradually widening the cavity 14 along the vertical direction as the rear section 14B of the cavity 14 extends back from the front section 14A, and the rear end of the slanted surface 17A connects to the inner peripheral wall of the rear section 14B of the cavity 14. The slanted surface 17A guides the leading end of the tab 31 into the front section 14A of the cavity 14 during insertion of the male terminal fitting 30 into the cavity 14. The seal 50 inserted into the rear section 14B of the cavity 14 will contact the rear end of the slanted surface 17A.

The connector of the third embodiment is assembled, as shown in FIGS. 8, 12 and 13, by mounting the seal 50 on the male terminal fitting 30 from the leading end of the tab 31 so that the seal 50 is in close sliding contact with the tab 31. The rear surface of the seal 50 contacts the contact surfaces 41 of the stoppers 41A when the seal 50 reaches the mount portion 38 of the tab 31 to prevent any further movement of the seal 50. The stoppers 41A stand up from the upper and lower surfaces of the tab 31 to define a large contact area between the rear surface of the seal 50 and the contact surfaces 41. Further, the respective contact surfaces 41 are point-symmetric with respect to the tab 31. Thus, the rear surface of the seal 50 is in contact with the contact surfaces 41 in a well-balanced manner, and the seal 50 can be held stably on the male terminal fitting 30.

Figure 9:
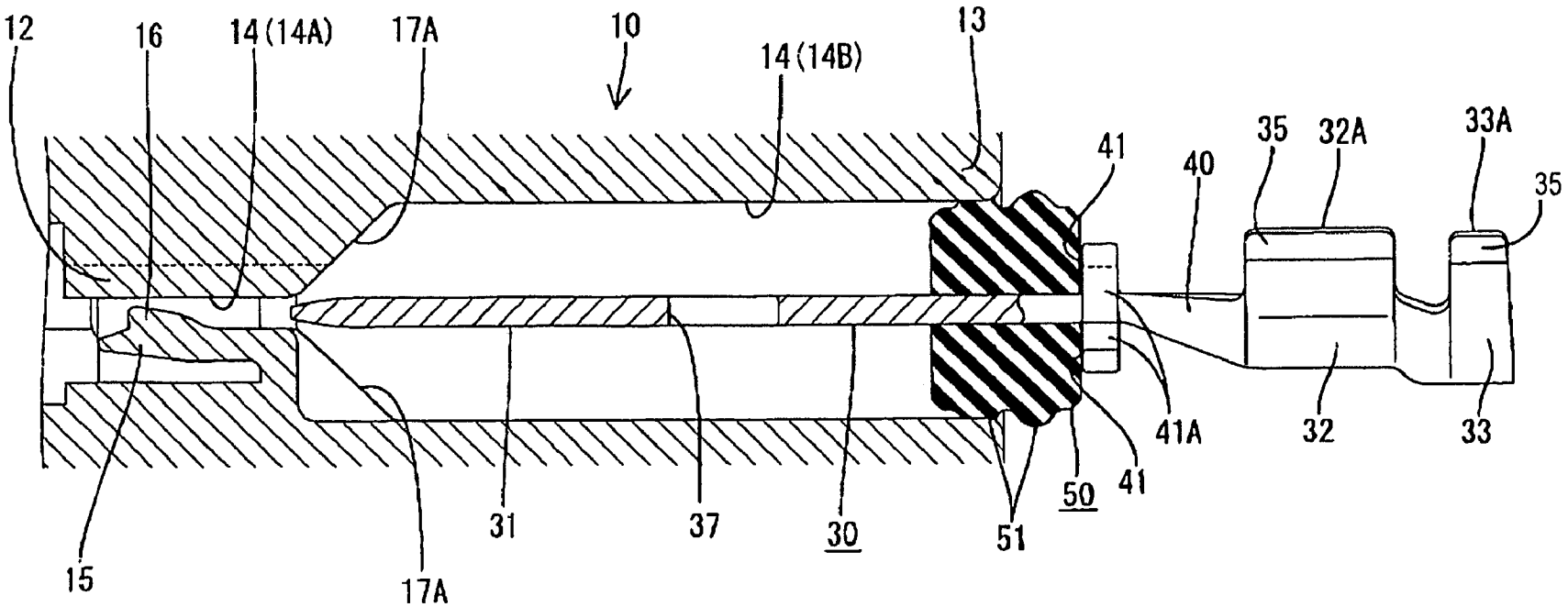
FIG. 9 is a section showing a state where a male terminal fitting is being inserted in a cavity.

The male terminal fitting 30 then is inserted into the cavity 14 together with the seal 50. The seal 50 can be inserted into the rear section 14B of the cavity 14 only if the major axis of the cross section of the seal 50 along the direction normal to longitudinal direction extends vertically, as shown in FIG. 9. Thus, the cross sections of the seal 40 and the rear section 14B of the cavity 14 conform to enable insertion of the seal 50 into the cavity rear half 14B. The leading end of the tab 31 may be displaced vertically from the rear-end opening of the front section 14A cavity 14. However, the slanted surface 17A guides the tab 31 to the rear-end opening of the front section 14A of the cavity 14.

Figure 10:
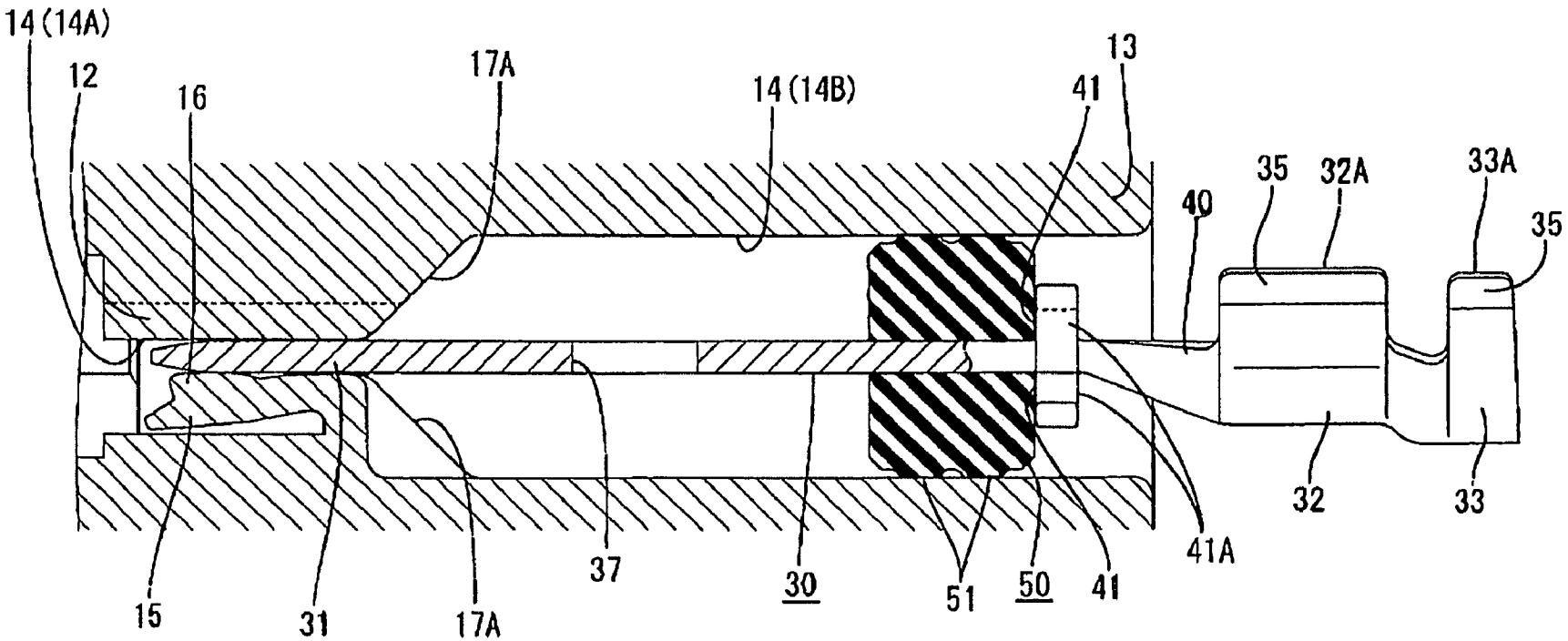
FIG. 10 is a section showing a state where the male terminal fitting is further inserted into the cavity from the state of FIG. 9.
Figure 11:
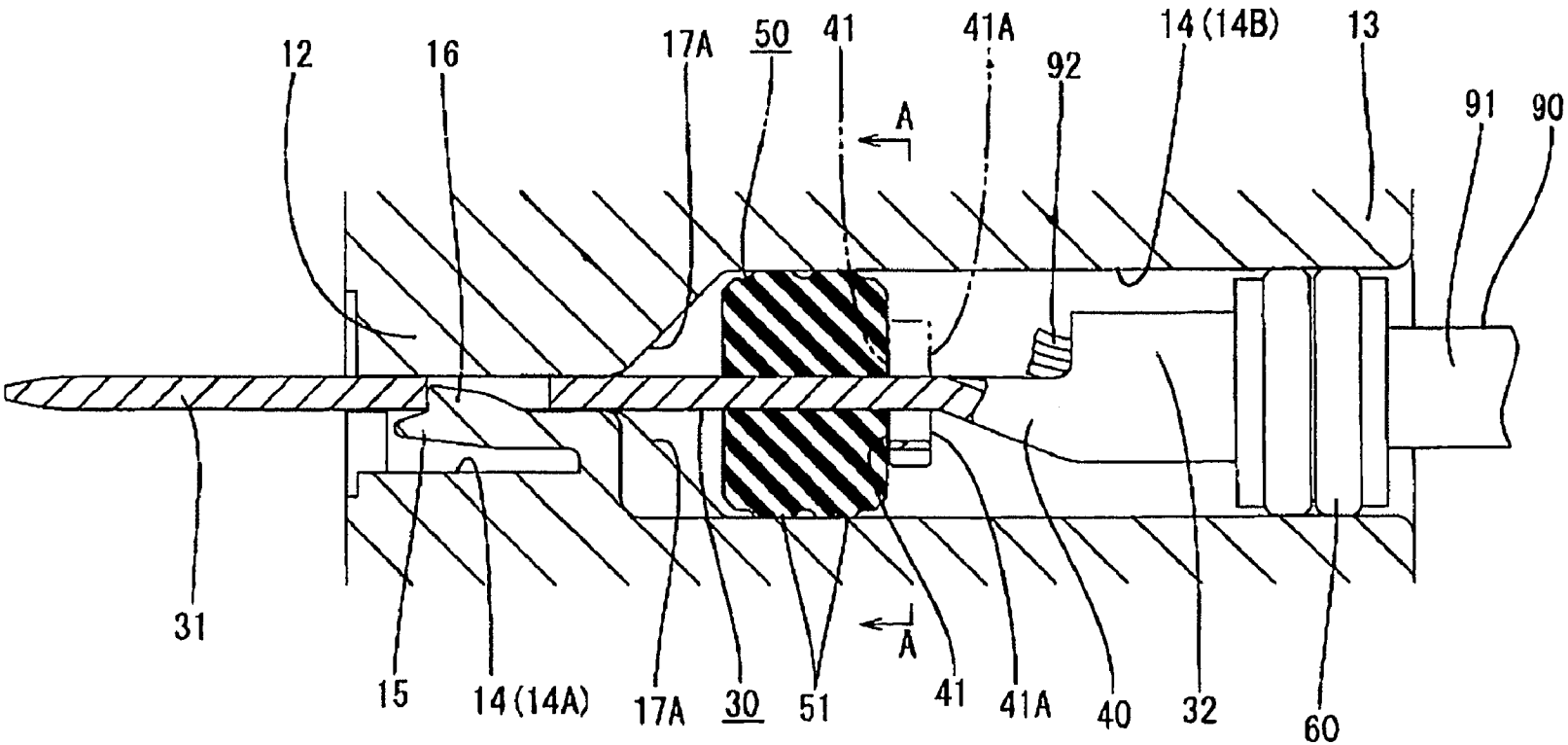
FIG. 11 is a section showing a state where the male terminal fitting is inserted to a proper position in the cavity.

When the male terminal fitting 30 is pushed further, as shown in FIG. 10, the tab 31 is inserted into the front section 14A of the cavity 14. When the male terminal fitting 30 reaches a proper insertion position, as shown in FIG. 11, the seal 50 is located at the end of the rear section 14B of the cavity 14 and the front surface of the seal 50 abuts the rear end of the slanted surface 17A to position the seal 50 along the forward direction.

As described above, according to the third embodiment, the male terminal fitting 30 is insertable into the cavity 14 only in a posture where the major axis of the cross section of the seal 50 aligns with the major axis of the cavity 14. This prevents the male terminal fitting 30 from being inserted into the cavity 14 while being angularly displaced.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Although the seal is mounted on the male terminal fitting in the foregoing embodiments, it may be mounted on a female terminal fitting according to the invention. In short, it is sufficient for the sealing member to be mounted before a wire barrel of a terminal fitting.

Although the seal is a unitary piece in the foregoing embodiments, it may be comprised of a pair of sections for holding a terminal fitting from opposite sides along thickness direction according to the invention. The seal may also be made of a gel according to the present invention.

The seals are mounted individually on the respective terminal fittings in the foregoing embodiments. However, the seal may be one-piece capable of holding a plurality of terminal fittings together according to the invention.

In the third embodiment, the contact surfaces 41 are formed by bending the stopper 41A extending from the left edge of the tab 31 in FIG. 14 to extend upward of the tab 31 and bending the stopper 41A extending from the right edge of the tab 31 in FIG. 14 to extend downward of the tab 31. However, the present invention is not limited thereto. The contact surfaces 41 can be provided within a width range of the tab 31. For example, they may be formed by making an H-shaped cut in the tab 31 and bending two sections defined by this cut in opposite directions.

In the third embodiment, each seal 50 has a substantially elliptical cross section whose major axis extends vertically, and each cavity rear half 14B has a substantially elliptical cross section whose major axis extends vertically. However, the invention is not limited thereto, and each seal 50 may have a substantially elliptical cross section whose major axis extends widthwise while each rear section 14B cavity 14 may have a substantially elliptical cross section whose major axis extends widthwise. It is sufficient for the seal 50 to conform to the cross section of the rear section 14B of the cavity 14 and to be insertable into the rear section 14B of the cavity 14 only when the seal 50 is inserted in a predetermined proper angular posture.

What is claimed is:

1. A watertight connector, comprising:

a housing formed with at least one cavity;

a male terminal fitting having opposite front and rear ends and being configured for mounting in the cavity, tab at the front end of the terminal fitting and being configured for connection with a mating terminal fitting, a rear portion of the tab having forwardly facing contact surfaces, a portion of the tab forward of the contact surfaces having a rearwardly facing step surfaces, portions of the tab between the contact surfaces and the step surfaces being cross-sectionally smaller than portions of the tab rearward of the contacts surfaces and forward of the step surfaces, and a wire barrel behind the tab and being configured for connection with a wire; and a circumferentially continuous seal mounted on the tab of the terminal fitting before the wire barrel and being configured for closely contacting an inner wall surface of the cavity, the seal extending continuously along the cross-sectionally smaller portion of the tab so that the contact surfaces contact a rear surface of the seal for limiting rearward movement of the seal on the tab and so that the step surfaces engage a front surface of the seal for preventing withdrawal of the seal in a forward direction from the tab.

2. The watertight connector of claim 1, wherein the tab has an interlocking portion at a position before a mount position of the seal and engageable with a resiliently deformable lock in the cavity.

3. The watertight connector of claim 1, wherein the contact surfaces are continuous with the tab and point-symmetric with respect to the tab.

4. The watertight connector of claim 1, wherein the tab is a substantially flat plate with four beveled corners.

5. The watertight connector of claim 1, wherein:

the seal has a substantially elliptical cross section along a direction normal to a longitudinal direction, and the cavity is formed to conform to the cross section of the seal to enable insertion of the seal only when the seal is inserted in a predetermined proper angular posture.

6. The watertight connector of claim 1, wherein the terminal fitting has a mount portion for receiving the seal, the mount portion including at least one narrow restricting portion.

7. The watertight connector of claim 1, further comprising sidewalls extending unitarily forward from the wire barrel, contact surfaces being formed at front edges of the sidewalls for limiting rearward movement of the seal on the terminal fitting.

* * * * *